United States Patent [19]

Oguro et al.

[11] Patent Number: 4,752,720

[45] Date of Patent: Jun. 21, 1988

[54] MAGNETRON WITH FIFTH HARMONIC SUPPRESSION PROJECTION IN THROUGH CAPACITOR SEAL

[75] Inventors: Tomokatsu Oguro; Mamoru Tsuzurahara, both of Mobara, Japan

[73] Assignee: Hitachi, Ltd., Tokyo, Japan

[21] Appl. No.: 807,247

[22] Filed: Dec. 10, 1985

[30] Foreign Application Priority Data

Dec. 12, 1984 [JP] Japan ..... 59-260705
Feb. 1, 1985 [JP] Japan ..... 60-16518
Feb. 6, 1985 [JP] Japan ..... 60-19901

[51] Int. Cl.[4] ..... H01J 1/52; H01J 25/50

[52] U.S. Cl. ..... 315/39.51; 315/39; 315/39.53; 315/85; 333/182; 331/86

[58] Field of Search ..... 315/39, 39.51, 39.53, 315/39.55, 85; 333/182, 77, 79; 331/86

[56] References Cited

U.S. PATENT DOCUMENTS

| | | | |
|---|---|---|---|
| 3,681,652 | 8/1972 | Domenichini et al. | 315/39.51 |
| 3,967,087 | 6/1976 | Kanuma | 315/39.51 |
| 4,065,701 | 12/1977 | Haugsjaa et al. | 315/39 |
| 4,163,175 | 7/1979 | Tashiro | 315/39.51 |
| 4,207,496 | 6/1980 | Nakai | 315/39.53 |

*Primary Examiner*—David K. Moore
*Assistant Examiner*—Michael J. Nickerson
*Attorney, Agent, or Firm*—Antonelli, Terry & Wands

[57] ABSTRACT

A magnetron with a filter case housing a through-type capacitor and a choke coil wherein a mounting plate for the capacitor is fixed in intimate contact with the wall of the filter case along a line encircling a through-hole drilled in the wall of the filter case for drawing out the terminals of the capacitor.

12 Claims, 8 Drawing Sheets

MAGNETRON WITH FIFTH HARMONIC SUPPRESSION PROJECTION IN THROUGH CAPACITOR SEAL

BACKGROUND OF THE INVENTION

1. Field of the Invention

The present invention relates to a magnetron, and more particularly, to a structure for mounting a noise removing filter circuit which prevents noise waves produced by the magnetron body from leaking out as unneeded radiation through a cathode circuit portion.

2. Description of the Prior Art

FIG. 1 is a longitudinal section showing an example of the conventional magnetron used in an electronic range. Reference numeral 1 denotes the thermionic valve body of the magnetron with cooling fins 2 being attached to the periphery of the valve by press fitting. Reference numeral 3 denotes a ferrite permanent magnet which produces a static magnetic field along the valve axis in the space of action accommodated within the thermionic valve body of the magnetron, and a yoke 4 supports this permanent magnet 3 so as to enclose the same on all sides, thereby forming a magnetic circuit. Holes are drilled in the upper and lower portions of the yoke 4, and an antenna portion for drawing the output of the above-mentioned thermionic valve body 1 and a cathode input portion for feeding electric power to the cathode are disposed so as to pass through the lower and upper holes, respectively. A filter case 5 is disposed so as to surround the cathode input portion, housing a through-type capacitor 6 constituting part of this filter which is supported by the case wall through which it passes. Also, a choke coil 7 constituting part of this filter is connected at one end to the capacitor 6 and at the other end to a cathode terminal 8. The upper opening of the case 5 is sealed by a lid 9. In this construction, the choke coil 7 and the capacitor 6 mainly perform the function of preventing the leakage of radiation contained by the television bandwidth which is propagated through an input line while the magnetron is in operation, and the filter case 5, sealed by the lid 9, possesses the function of trapping other unneeded waves such as the higher harmonics of the fundamental wave (normally 2.45 GHz) produced by the magnetron.

FIG. 2(*a*) is a fragmentary view as viewed in the direction shown by the arrow Z in FIG. 1, illustrating the manner wherein the capacitor 6 of the filter is mounted in the filter case 5, in which symbol 6*a* denotes a mounting plate for the capacitor 6, and symbol 6*b* an insulating tubular portion which covers a through conductor 6*c*. In order to secure the mounting plte 6*a* to the case 5, burring portions 5*a* are provided in the positions corresponding to the respective corners of the mounting plate 6*a*. FIG. 2(*b*) is an enlarged fragmentary cross-sectional view of the burring portion 5*a* cutaway longitudinally along the axis thereof, wherein the mounting plate 6*a* having holes which receive the respective burring portions 5*a* of the filter case 5 as illustrated, is fixed to the wall of the filter case 5 by caulking the end 5*b* of the respective burring portion 5*a*.

This conventional method of mounting the filter causes the following problems.

(a) Since the mounting plate 6*a* for the capacitor is fixed only at the four burring portions 5*a*, some interstices are formed between the filter case wall and the mounting plate 6*a* over the length between the burring portions, and thereby, shielding effects are deteriorated particularly above the fifth harmonic which has a high frequency.

(b) The filter case 5 and the capacitor mounting plate 6*a* tend to suffer from curvature, and the interstices remain considerably uneven after caulking.

(c) Unneeded radiation leaks out of the holes of the burring portions 5*a* for joining the mounting plate 6*a* to the filter case 5.

Hence, the filter case 5 and the capacitor mounting plate 6*a* do not conform with each other perfectly, thus making it impossible for them to be joined closely to each other owing to the fact that either may suffer slight curvature. In addition to these problems, since the commencement of satellite broadcasting, the leakage of higher harmonics which are components of the unneeded waves emanating from the magnetron has recently become a target for strict regulation. In spite of these critical situations, however, it has been found that prior art magnetrons entail the risk of leakage not only out of the above-described slight interstices between joint faces but also through the holes of the burring portions 5*a* of the filter case 5 which were described with reference to FIG. 2.

SUMMARY OF THE INVENTION

The present invention aims to provide a magnetron which does not involve any problem such as that of the above-described conventional magnetrons and reduces the leakage of unneeded radiation, particularly, that of the fifth harmonic which is remarkably close to the frequencies of satellite broadcasting, which is generated from the fundamental wave of a magnetron for use in an electronic range.

In accordance with the present invention, a metal plate for mounting a capacitor is intimately attached to the wall of a filter case by means of welding, fitting and so forth. Additionally, these processes such as welding and fitting are conducted in such a manner that a looped line encircles the periphery of a mounting hole for a through-type capacitor, the length from the welded portion to the edge of the periphery of the metal plate for mounting the capacitor being rendered one quarter of the wavelength of the fifth harmonic which is generated from the fundamental oscillating wave of the magnetron, and a choke being formed at this portion with respect to this harmonic, whereby two-stage attenuating effects are obtained.

Further objects, features and advantages of the present invention will become apparent from the following description of a preferred embodiment of the invention with reference to the accompanying drawings.

BRIEF DESCRIPTION OF THE DRAWINGS

FIG. 2(*b*) is an enlarged fragmentary cross-sectional view showing a burring portion whereby a capacitor mounting plate is fixed to the wall of the filter case;

FIG. 3(*b*) is a cross-sectional view showing the specific structure of the capacitor mounting portion in accordance with the present invention.

DESCRIPTION OF THE PREFERRED EMBODIMENTS

Figure 1:
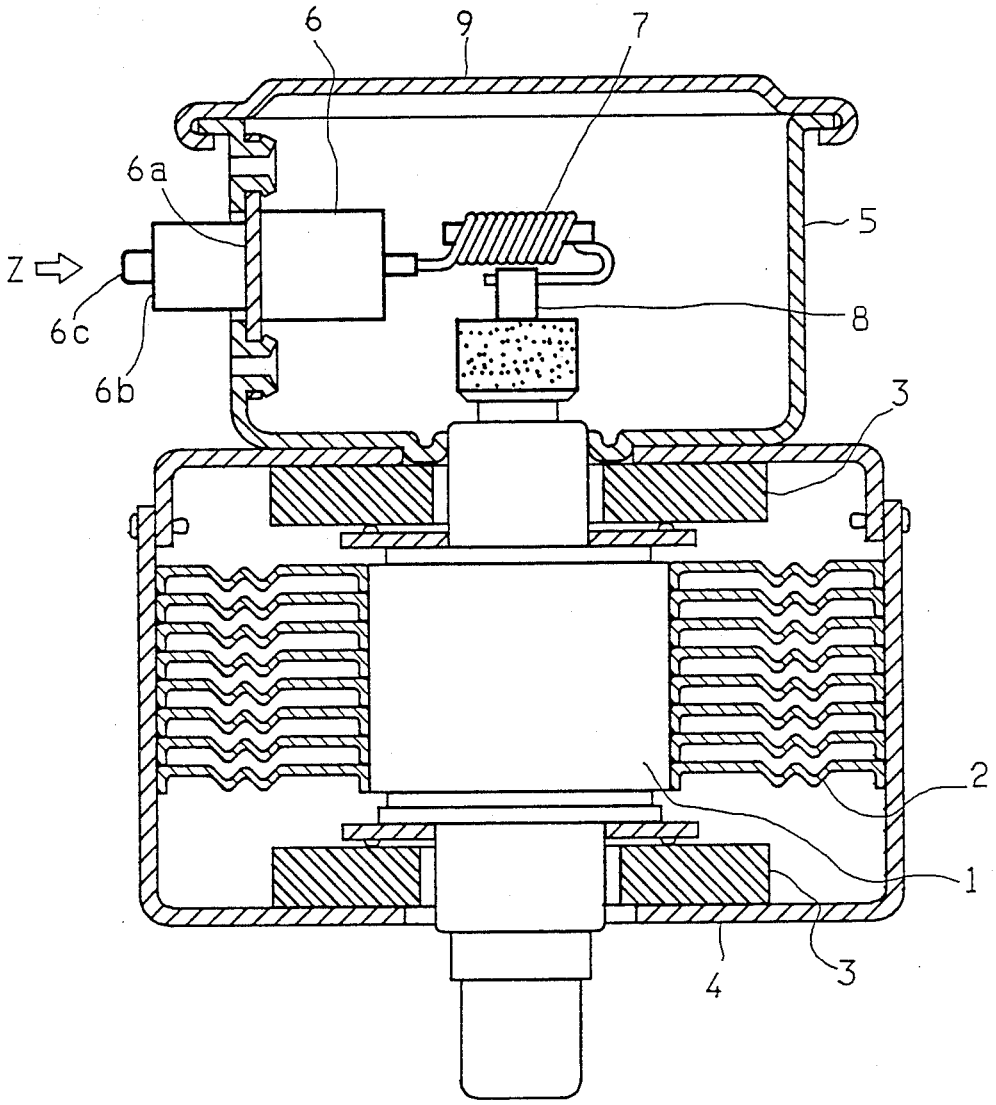
FIG. 1 PRIOR ART
FIG. 1 is a longitudinal cross-sectional view of a conventional magnetron.
Figure 2A:
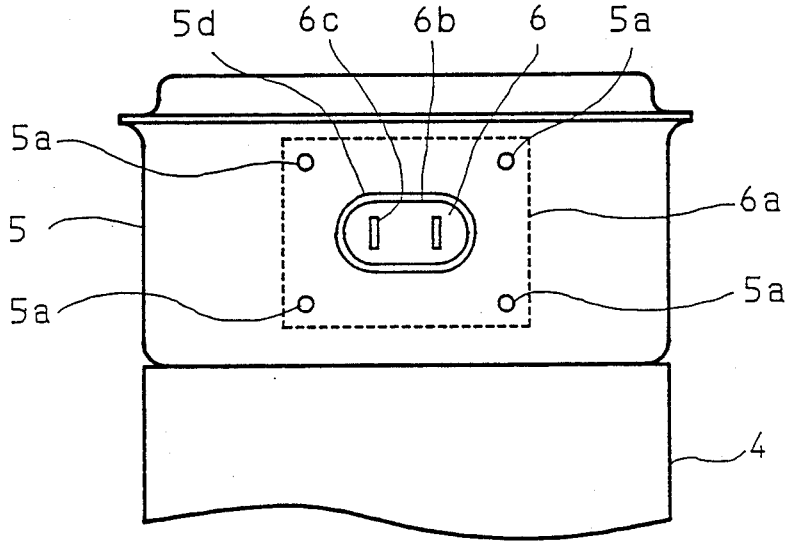
FIG. 2(a) PRIOR ART
FIG. 2(*a*) is a view showing the manner wherein a capacitor is mounted on a filter case as in a prior art device.
Figure 2B:
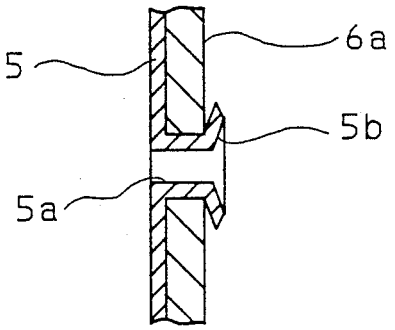
FIG. 2(b) PRIOR ART
Figure 3A:
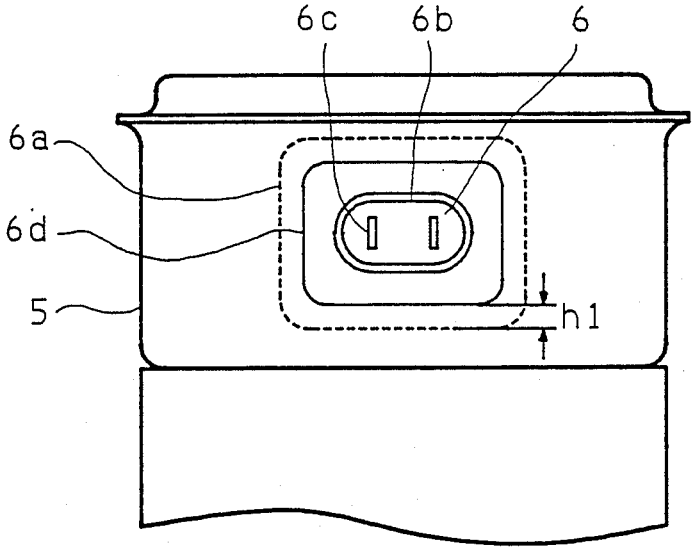
FIG. 3(*a*) is a view of one embodiment of this invention, taken in the direction of through lead wires 6*c*, showing the manner of mounting the capacitor.
Figure 3B:
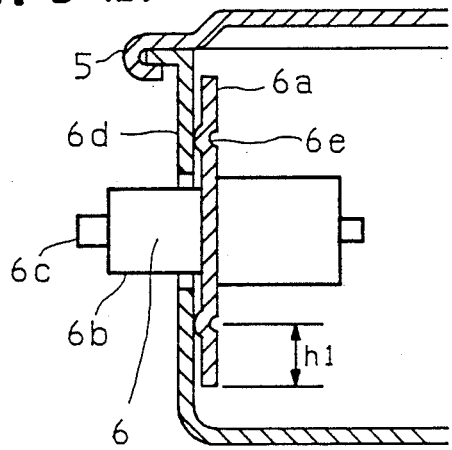

FIG. 3(a) is a view taken in the direction of through lead wires, showing the manner wherein the through-type capacitor 6 is mounted on the filter case 5 by welding, in which symbol 6d denotes a welded portion and symbol h1, about 6.1 mm across, is equal to one quarter of the wavelength of the fifth harmonic of the fundamental wave emanating from the magnetron. The welded portion 6d is formed in the shape of a line encircling the periphery of the mounting hole for mounting the through-type capacitor 6. Specifically, as shown in FIG. 3(b) in which the sectional view of this welded portion is illustrated, a raised portion 6e is formed on the metal plate for mounting the capacitor 6, this portion 6e being joined to the filter case 5 by resistance welding, thereby forming the welded portion 6d. Thus 6d and 6e are located in the same position. As described above, the periphery of the capacitor mounting metal plate 6a runs in parallel relationship with the welded portion 6d for a distance of about 6.1 mm, the four corners of the periphery of the metal plate 6a being therefore formed in a large sectorial shape. Normally, the leakage of unneeded waves is prevented by the welded portion 6d, and furthermore, even if any defective welded portions are partially found, the fifth harmonic is reflected by the edge portion of the periphery of the mounting metal plate 6a which displays choking effects, so that the quantity of unneeded waves which reaches the welded portion is reduced. Additionallly, since this embodiment has neither holes nor burring portions for mounting a capacitor, unlike conventional filter cases, the leakage of unneeded waves is materially small in this respect, too.

It is to be noted that, unlike the conventional method of mounting the capacitor at four burring portions, the present invention adopts a structure wherein resistance welding is effected in a continuous and linear manner so as to prevent the production of defective welded portions as much as possible, thus the strength of the capacitor mounting is improved, and the possibility of movement of the whole capacitor is entirely prevented, thereby reducing the level of noise caused by vibration.

Figure 4A:
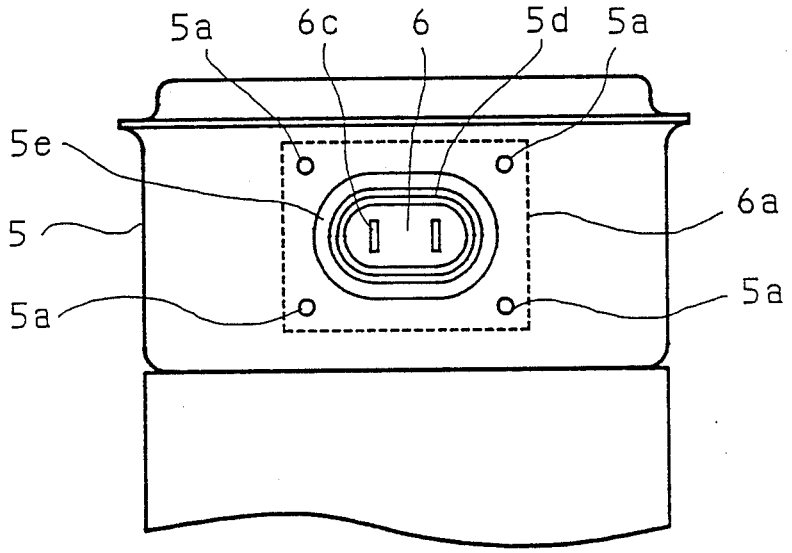
FIGS. 4a, 4b, 5a, 5b, 6a, 6b, 6c, 7a, 7b, 8a, 8b are cross-sections of the essential portions of other embodiments of the structures for preventing the leakage of waves of the magnetron in accordance with this invention, showing the manner wherein the capacitor is mounted on the filter case and the mounting portion thereof.
Figure 4B:
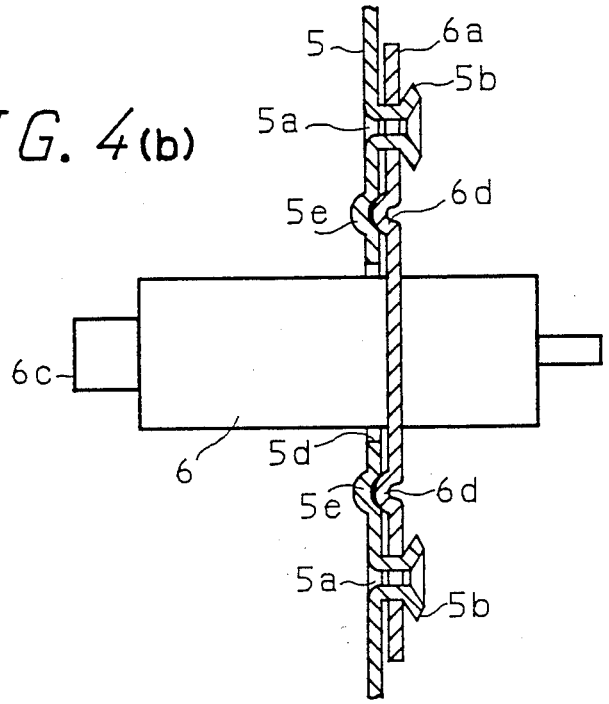

FIGS. 4(a) and 4(b) are views showing another embodiment in accordance with the present invention, respectively, wherein like symbols are used to denote like or corresponding portions which constitute each of the components shown in the figures previously referred to. In FIGS. 4(a) and 4(b), a formed portion 5e is provided around the periphery of a capacitor mounting through-hole 5d of the filter case 5, and the formed portion 5e which is located in close proximity to the periphery of the capacitor 6 has a semicircular sectional portion which projects outwardly from the filter case 5 giving the appearance of an elliptical arc. Also, on the mounting plate 6a for the capacitor 6 opposing the filter case 5, an elliptically formed portion 6d having the same structure is provided in the position corresponding to the above-mentioned elliptically formed portion 5e of the filter case 5. In this portion, the semicircular section of the elliptically formed portion 6d of the mounting plate 6a is so formed as to possess a curvature slightly greater than that of the elliptically formed portion 5e of the filter case 5.

The four burring portions 5a of the filter case 5 are then fitted over the corresponding four holes which are drilled in the mounting plate 6a and are fixed by caulking the four burring portions 5a, so that the elliptically formed portion 6d of the mounting plate 6a and the elliptically formed portion 5e of the filter case 5 are positively engaged and come into close contact with each other in a state which is generally close to a line or band contact. By so doing, the mounting plate and the wall of the filter case are closely joined in such a manner that they are closed all around the capacitor, thereby preventing the leakage of the fifth harmonic.

Figure 5A:
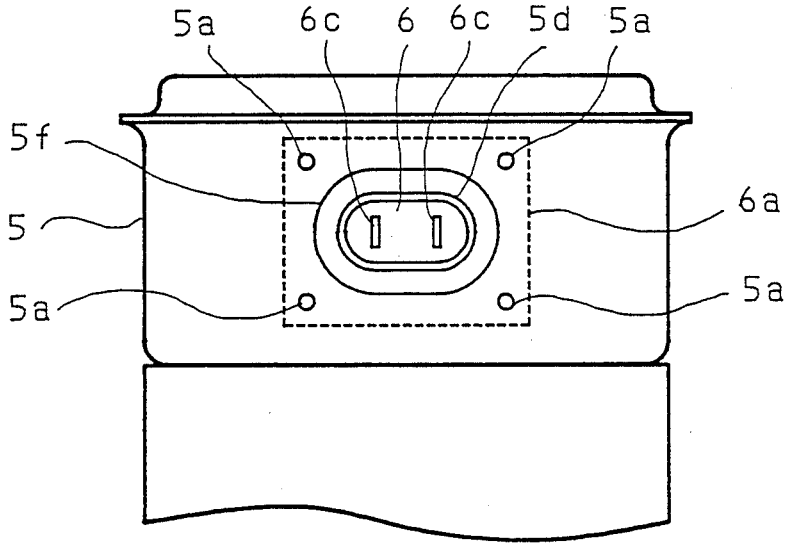
Figure 5B:
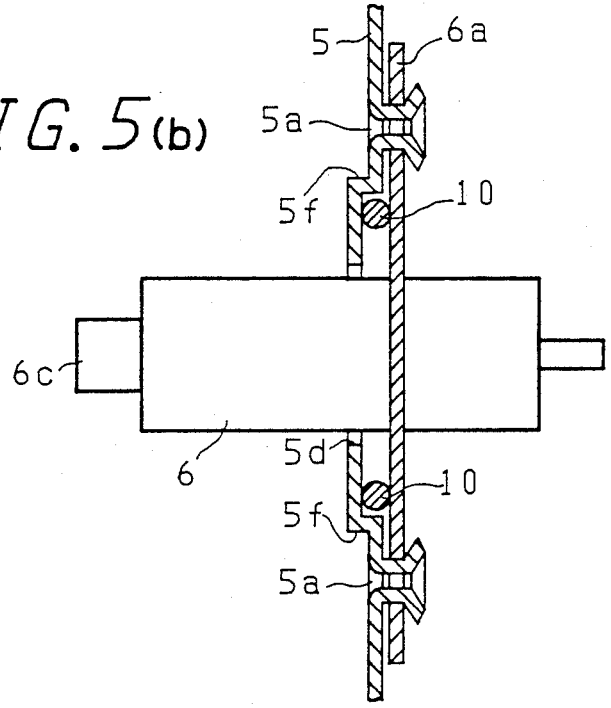

FIGS. 5(a) and 5(b) show another embodiment of this invention, in which like symbols are used to denote the like or corresponding portions which constitute each of the components shown in the figures previously referred to. In FIGS. 5(a) and 5(b), a press molded raised portion 5f is so formed as to outwardly project around the periphery of the capacitor mounting through-hole 5d of the filter case 5, a conductive elastic solid 10 such as a metallic mesh ring, a conductive rubber ring or an electroplated plastic ring being interposed between the raised portion 5f and the mounting plate 6a, and the mounting plate 6a being fixedly mounted on the filter case 5 by caulking the burring portions 5a.

In this construction as well, the filter case 5 is in line contact relationship with the mounting plate 6a with the conductive elastic solid 10 charged therebetween as well as a choke structure similar to the above being formed, thus obtaining remarkably good shielding effects to an extent similar to the above-described structure. In this case, since elasticity is high due to the use of the conductive elastic solid 10, more positive shielding effects can be obtained.

Additionally, in accordance with this construction, if capacitor 6 consists of a high dielectric material such as barium titanate or ceramics, the waveforms of the voltage source are not those of a direct current but those of a pulsating current having a steep rise and fall which normally generate acoustic noise, the elastic solid 10 is employed to absorb the vibration of the capacitor 6, thus enabling a reduction in the acoustic noise level.

Figure 6A:
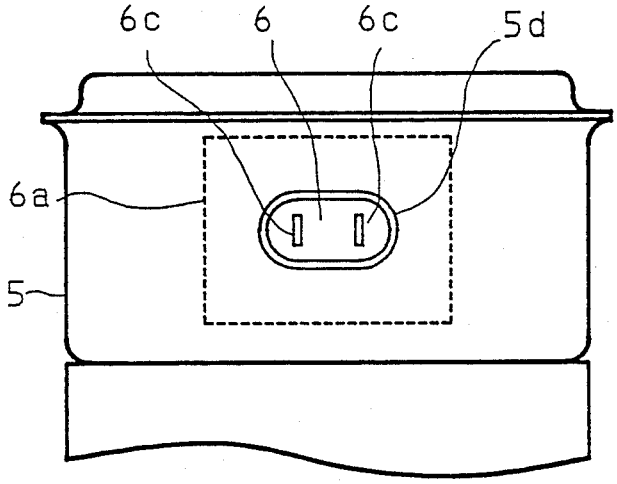
Figure 6C:
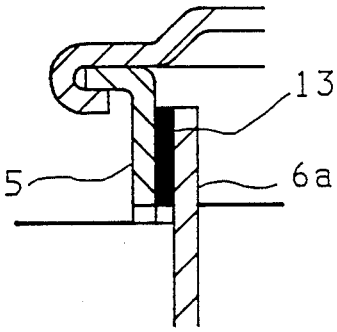
Figure 6B:
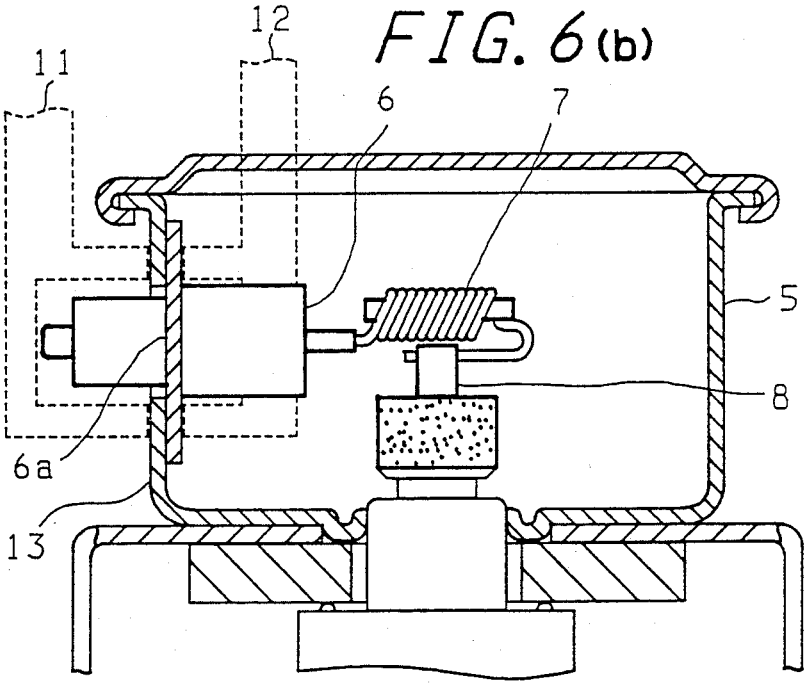

As shown in FIGS. 3 through 5, in the present invention fitting or pressure fitting is effected on the portion wherein the mounting plate for a through-type capacitor is fixedly joined to the filter case, in a state close to a line contact along the position corresponding to $\frac{1}{4}\lambda$ of the fifth harmonic described above in such a manner as to encircle the periphery of the through-hole of the filter case into which the through-type capacitor is inserted. As another preferred embodiment, the arrangement shown in FIGS. 6(a), 6(b) and 6(c) may be such that the side of the mounting plate 6a for the through-type capacitor 6 which opposes the filter case 5 is plated, with, for example, Sn-Pb solder, and the filter case 5 and the mounting plate 6a for the capacitor 6 are thereafter pressedly heated by means of heating jigs 11 and 12 shown by broken lines, thus allowing the solder plated on the mounting plate 6a to be fused to the filter case and the mounting plate and thereby joining them together.

In accordance with this construction, since zinc is galvanized over the surface of the filter case 5, solderability becomes optimal as shown in the enlarged view of the fused portion of FIG. 6(*c*), thus enabling a reliable and high quality fusion.

Figure 7A:
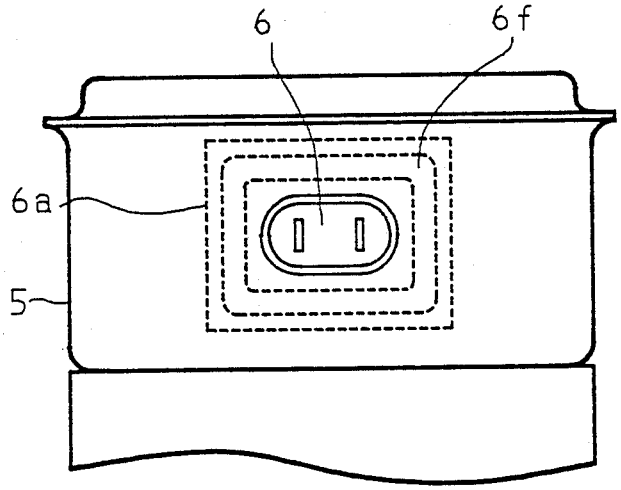
Figure 7B:
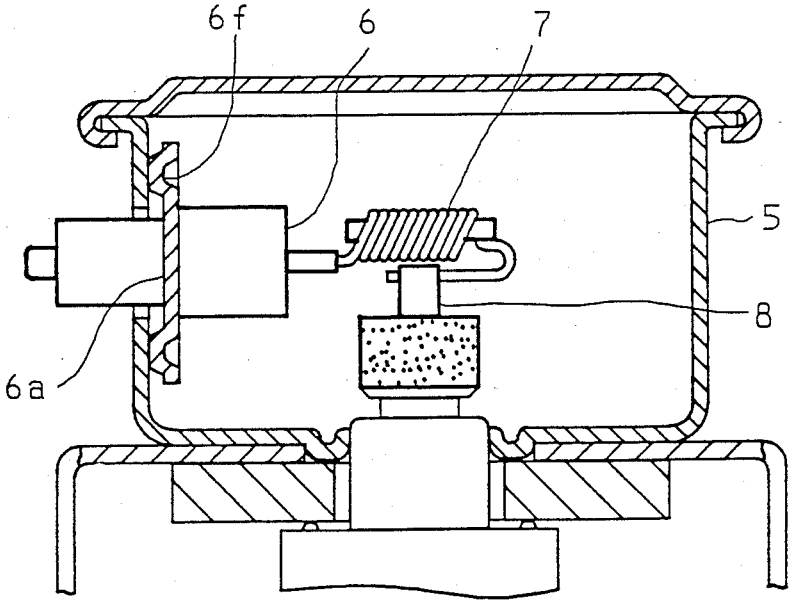

Also, as shown in FIGS. 7(*a*) and 7(*b*), a frame-like raised portion 6*f* may be formed on the mounting plate 6*a* for the capacitor 6 so as to join by fusion the joint surfaces of the raised portion 6*f* and the filter case 5. In accordance with this construction, heat concentration is improved on the joint surfaces of the filter case 5 and the raised portion 6*f* of the mounting plate 6*a*, therefore enabling a more efficient soldering process.

It is a matter of course that, although the raised portion 6*f*, in FIG. 7, is provided on the mounting plate 6*a*, the same effects can also be achieved by forming a similar raised portion on the filter case 5 or on both the plate and the case.

Figure 8:
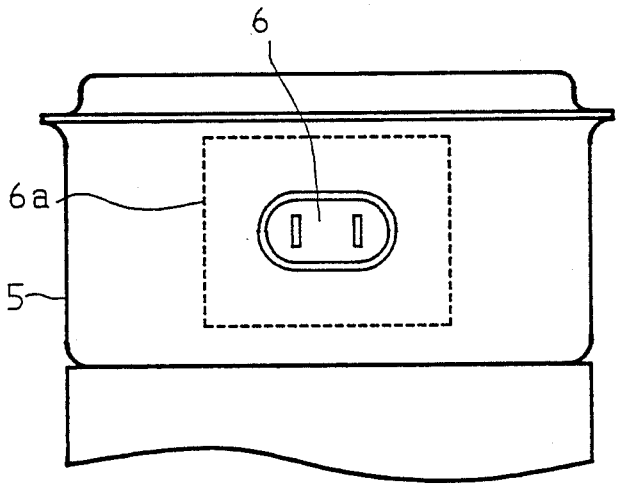
Figure 8:
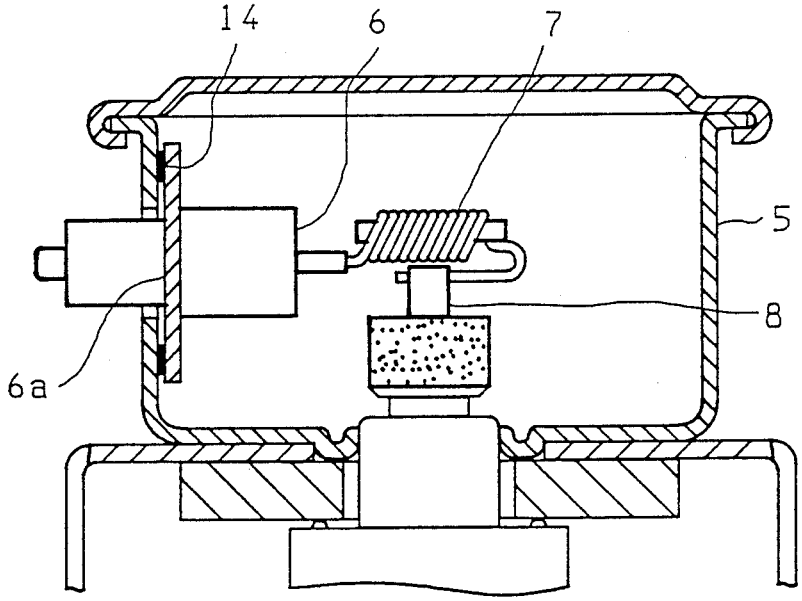

Furthermore, as shown in FIGS. 8(*a*) and 8(*b*), a frame-like solder sheet 14 clamped between the mounting plate 6*a* and the filter case 5 can be used to obtain satisfactory solderability. This easily enables the prevention of the leakage of waves. It is to be noted that this solder sheet 14 may be replaced with wire-like solder, or alternatively powdered solder may be applied in a pasted state.

In accordance with this invention, a line contact portion is provided between the filter case and the capacitor mounting plate, thereby greatly reducing the leakage of unneeded waves, with the result that a magnetron of high quality and reliability can be achieved. Also, since the filter case and the mounting plate are intimately joined by fusion through the line contact portion, there are few variations (or defects of unevenness) due to assemblage, and moreover, a magnetron wherein incidence of the leakage of unneeded waves is remarkably small can be realized with a large measure of stability. Further, in addition to these features, since the thickness of the filter case and the capacitor mounting plate can be reduced to the extent of being remarkably thin, this invention also allows the achievement of significant reductions in material and manufacturing costs.

Also, if the portions to be fixed are perfectly joined by fusing with solder, the leakage of unneeded waves through these portions can be substantially completely prevented.

What is claimed is:

1. A magnetron comprising:

a thermionic valve body onto which a radiator fin and a permanent magnet are fitted;

a cathode input portion projecting out of a yoke surrounding said thermionic valve body, said radiator fin and said permanent magnet;

a filter case connected to said yoke;

a through-type capacitor mounted to said filter case with a conductive mounting plate and connected to a terminal of said cathode input portion located within said filter case by a choke coil;

said through-type capacitor being mounted to said filter case such that terminals of said through-type capacitor which are not connected to said choke coil are drawn out of a through-hole drilled in a wall of said filter case; and said conductive mounting plate being in intimate contact with said filter case along a continuous line encircling said through-hole drilled in said wall of said filter case;

wherein said line encircling said through-hole is formed by a raised portion of said conductive mounting plate provided inside the periphery of said conductive mounting plate and said line is spaced from the periphery of said conductive mounting plate by a distance of one quarter wavelength of a harmonic frequency of the fundamental wave of said magnetron.

2. A magnetron comprising:

a thermionic valve body onto which a radiator fin and a permanent magnet are fitted;

a cathode input portion projecting out of a yoke surrounding said thermionic valve body, said radiator fin and said permanent magnet;

a filter case connected to said yoke;

a through-type capacitor mounted to said filter case with a conductive mounting plate and connected to a terminal of said cathode input portion located within said filter case by a choke coil;

said through-type capacitor being mounted to said filter case such that terminals of said through-type capacitor which are not connected to said choke coil are drawn out of a through-hole drilled in a wall of said filter case; and said conductive mounting plate being in intimate contact with said filter case along a continuous line encircling said through-hole drilled in said wall of said filter case;

wherein said intimate contact is made by mutual engagement of a projection formed in said conductive mounting plate into a projection formed in said wall of said filter case along said line encircling said through-hole drilled in said wall of said filter case, and by fixation of said conductive mounting plate and said wall of said filter case by caulking, said projections having a semicircular cross-section.

3. A magnetron comprising:

a thermionic valve body onto which a radiator fin and a permanent magnet are fitted;

a cathode input portion projecting out of a yoke surrounding said thermionic valve body, said radiator fin and said permanent magnet;

a filter case connected to said yoke;

a through-type capacitor mounted to said filter case with a conductive mounting plate and connected to a terminal of said cathode input portion located within said filter case by a choke coil;

said through-type capacitor being mounted to said filter case such that terminals of said through-type capacitor which are not connected to said choke coil are drawn out of a through-hole drilled in a wall of said filter case; and said conductive mounting plate being in intimate contact with said filter case along a continuous line encircling said through-hole drilled in said wall of said filter case;

wherein said intimate contact is made by a conductive elastic solid interposed between said wall of said filter case and said conductive mounting plate along said line encircling said through-hole.

4. A magnetron according to claim 1, wherein said harmonic frequency of the fundamental wave of said magnetron is the fifth harmonic frequency.

5. A magnetron according to claim 2, wherein said line encircling said through-hole is inside the periphery of said conductive mounting plate and is spaced therefrom by a distance of one quarter wavelength of a harmonic frequency of the fundamental wave of said magnetron.

6. A magnetron according to claim 5, wherein said harmonic frequency of the fundamental wave of said magnetron is the fifth harmonic frequency.

7. A magnetron according to claim 3, wherein said line encircling said through-hole is inside the periphery of said conductive mounting plate and is spaced therefrom by a distance of one quarter wavelength of a harmonic frequency of the fundamental wave of said magnetron.

8. A magnetron according to claim 7, wherein said harmonic frequency of the fundamental wave of said magnetron is the fifth harmonic frequency.

9. A magnetron comprising:

a thermionic valve body onto which a radiator fin and a permanent magnet are fitted;

a cathode input portion projecting out of a yoke surrounding said thermionic valve body, said radiator fin and said permanent magnet;

a filter case connected to said yoke;

a through-type capacitor mounted to said filter case with a conductive mounting plate and connected to a terminal of said cathode input portion located within said filter case by a choke coil;

said through-type capacitor being mounted to said filter case such that terminals of said through-type capacitor which are not connected to said choke coil are drawn out of a through-hole drilled in a wall of said filter case; and said conductive mounting plate being in intimate contact with said filter case along a continuous line encircling said through-hole drilled in said wall of said filter case;

wherein said intimate contact is made by soldering said conductive mounting plate to said filter case along said line encircling said through-hole drilled in said wall of said filter case.

10. A magnetron comprising:

a thermionic valve body onto which a radiator fin and a permanent magnet are fitted;

a cathode input portion projecting out of a yoke surrounding said thermionic valve body, said radiator fin and said permanent magnet;

a filter case connected to said yoke;

a through-type capacitor mounted to said filter case with a conductive mounting plate and connected to a terminal of said cathode input portion located within said filter case by a choke coil;

said through-type capacitor being mounted to said filter case such that terminals of said through-type capacitor which are not connected to said choke coil are drawn out of a through-hole drilled in a wall of said filter case; and said conductive mounting plate being in intimate contact with said filter case along a continuous line encircling said through-hole drilled in said wall of said filter case;

wherein said intimate contact is made by forming a raised portion along said line encircling said through-hole drilled in said wall of said filter case and by fusing or welding said raised portion to said wall of said filter.

11. A magnetron according to claim 10, wherein said line encircling said through-hole is inside the periphery of said conductive mounting plate and is spaced therefrom by a distance of one quarter wavelength of a harmonic frequency of the fundamental wave of said magnetron.

12. A magnetron according to claim 11, wherein said harmonic frequency of the fundamental wave of said magnetron is the fifth harmonic frequency.

* * * * *